United States Patent [19]

Tietjens

[11] 4,151,645

[45] May 1, 1979

[54] DRY-SHAVING APPARATUS WITH HAIR-PULLING LEAD CUTTERS

[75] Inventor: Eduard W. Tietjens, Drachten, Netherlands

[73] Assignee: U.S. Philips Corporation, New York, N.Y.

[21] Appl. No.: 805,710

[22] Filed: Jun. 13, 1977

[30] Foreign Application Priority Data

Jul. 7, 1976 [NL] Netherlands ..... 7607477

[51] Int. Cl.[2] ..... B26B 19/14

[52] U.S. Cl. ..... 30/43.6; 30/346.51

[58] Field of Search ..... 30/43.4, 43.5, 43.6, 30/346.51

[56] References Cited

U.S. PATENT DOCUMENTS

| | | | |
|---|---|---|---|
| 664,388 | 12/1900 | Drösse | 30/43.6 |
| 2,281,922 | 5/1942 | Dalkowitz | 30/43.6 |
| 2,795,042 | 6/1957 | Ritchey | 30/43.6 |
| 3,088,205 | 5/1963 | Ellis | 30/346.51 X |
| 3,962,784 | 6/1976 | Tietjens | 30/43.6 |

FOREIGN PATENT DOCUMENTS

| | | | |
|---|---|---|---|
| 2513017 | 10/1975 | Fed. Rep. of Germany | 30/346.51 |

*Primary Examiner*—Gary L. Smith

*Attorney, Agent, or Firm*—Thomas A. Briody; Simon L. Cohen; Rolf E. Schneider

[57] ABSTRACT

A dry-shaving apparatus comprising a cutter roller provided with straight shaving cutters each having an associated hair-pulling lead cutter, and a skin guide member and a shear-cutting member between which a helical hair-entrance aperture is formed.

3 Claims, 6 Drawing Figures

DRY-SHAVING APPARATUS WITH HAIR-PULLING LEAD CUTTERS

This invention relates to a dry-shaving apparatus having a cutter roller which is rotatable about a spindle, which roller comprises a plurality of shaving cutters with cutting edges, having a skin guide member and a shear-cutting member between which a slot-like hair-entrance aperture is formed.

Such a construction of a shaving apparatus is known from U.S. Pat. No. 664,388.

It is an object of the present invention to provide a construction which enables an even closer shave and the invention is characterized in that the cutting edges of the shaving cutters are parallel to the axis of the cutter roller, a hair-pulling lead cutter being associated with each shaving cutter, which lead cutter is arranged for resilience towards the outside, and that the hair-entrance aperture is helical in the longitudinal direction.

It is true that hair-pulling lead-cutters are known per se from U.S. Pat. No. 3,088,205, but the use thereof in conjunction with the shaving cutter of U.S. Pat. No. 644,388 is very difficult. According to the invention, the helical shape of the slot-like hair-entrance aperture prevents the resilient lead cutters from being trapped in said aperture.

Preferably, always at least one shaving cutter co-operates with the edge of the shear-cutting member, which edge bounds the hair entrance aperture.

Figure 1:
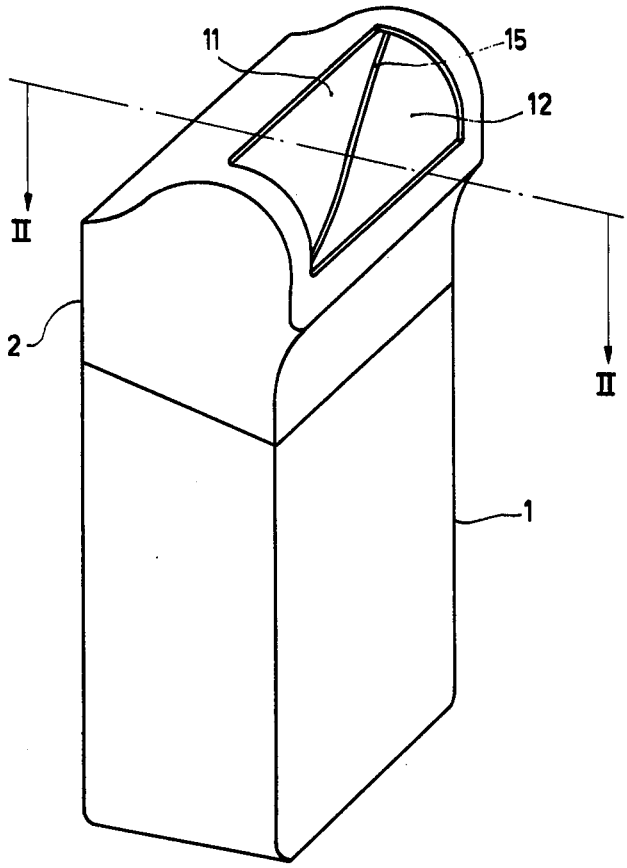
Figure 2:
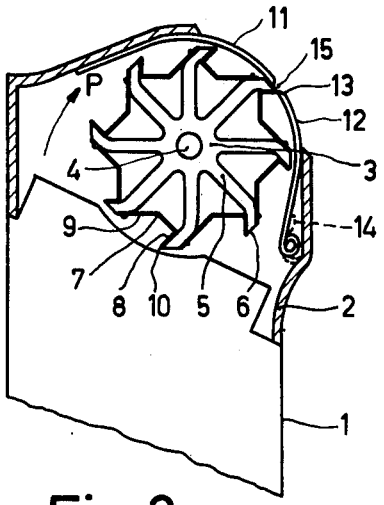
Figure 6:
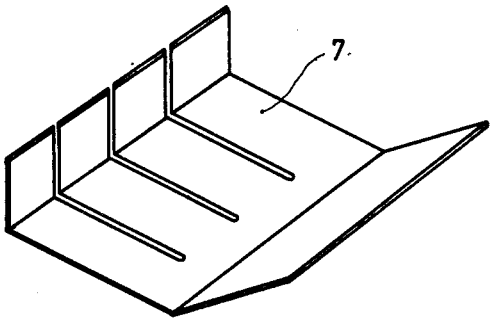

The invention will now be described in more detail with reference to the embodiment shown in the accompanying drawings, in which:

FIG. 1 is a perspective view of a shaving apparatus in accordance with the invention, FIG. 2 is a cross-section of the shaving head on an enlarged scale taken along the line II—II in FIG. 1, FIGS. 3–5 schematically represent how the shaving apparatus functions when a beard stubble is cut, and FIG. 6 shows a hair-pulling lead cutter consisting of resilient lamellae.

The dry-shaving apparatus in accordance with FIGS. 1 and 2 comprises a housing 1 on which a guard 2 is clamped. In the upper part of the housing 1 a cutter roller 3 is rotatably journalled about a spindle 4. The cutter roller 3 is driven by a motor accomodated in the housing 1 via a suitable transmission (not shown). The cutter roller 3 comprises a plurality of substantially radially extending shaving cutters 5 with straight cutting edges 6 which extend parallel to the spindle 4. Viewed in the direction of rotation P of the cutter roller 3 a lead cutter 7 is disposed in front of each shaving cutter 5. The length of these lead cutters is equal to that of the shaving cutters. The lead cutters 7 consist of flexible strips of oblique U-shaped cross-section, of which one limb 8 co-operates with the shaving cutter 5 and the other limb 9 is attached to the back of the preceding shaving cutter. The construction of the lead cutter is such that the limb 8 is arranged for resilience in a radial direction towards the shear-cutting member 12. The shear cutting member 12 with its cutting edge 13 is hingeably mounted in the guard 2 and is urged in the direction of the spindle 4 of the cutter roller 3 by a spring 14. Between the skin guide member 11 and the shear cutting member 12 is a slot-like hair entrance aperture 15 is formed. This aperture has such a shape, preferably helical, that always at least one shaving cutter 5 co-operates with the edge 13 of the resilient shear cutting member 12, so that the resilient shear cutting member 12 cannot become trapped between the cutting edges 6 of adjacent shaving cutters 5. Moreover, this ensures that the lead cutters 7 cannot penetrate the slot-like hair entrance aperture 15. The width of the slotted aperture 15 is selected so great as to allow all beard stubbles to straighten themselves, but so small that the skin is not touched by the moving shaving cutter. It is possible to make the width of the slot-like aperture adjustable, so that at option an aggressive or less aggressive action can be obtained. It is also possible to have a shaving apparatus with a plurality of slot-like apertures.

Figure 3:
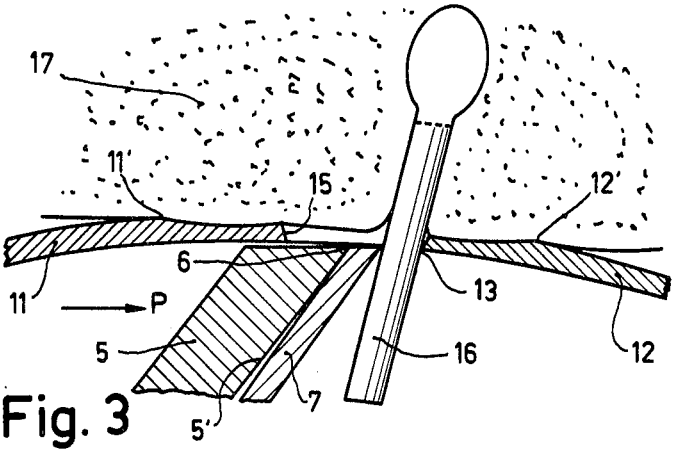
Figure 4:
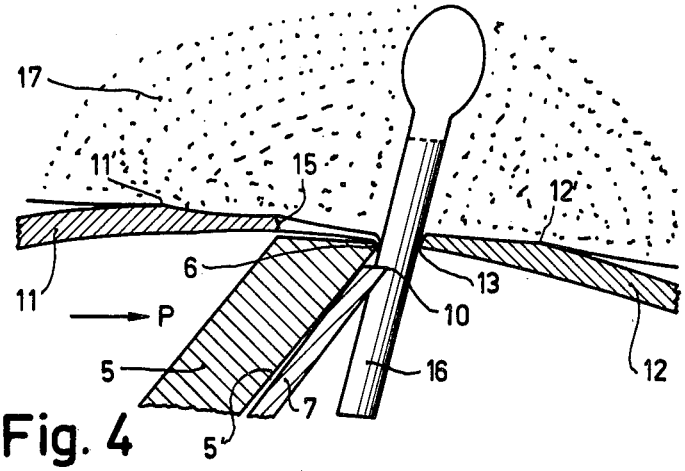
Figure 5:
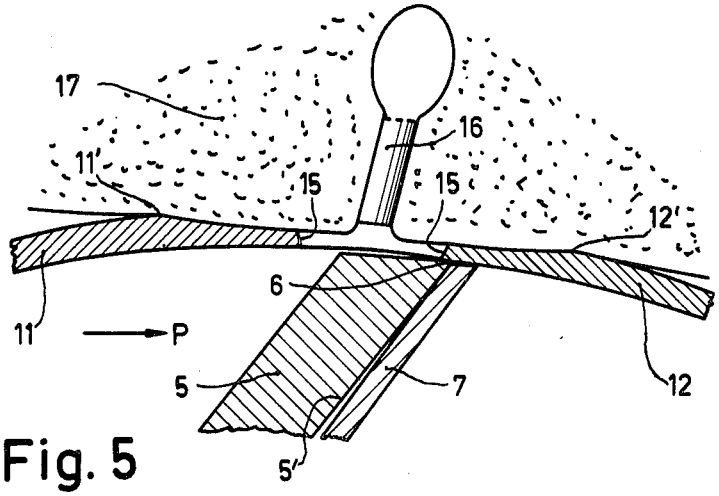

The operation of the lead cutter 7 is illustrated in FIGS. 3–5. FIG. 3 shows the situation in which a beard stubble 16 projects through the hair-entrance aperture 15 and is just pressed against the cutting edge 13 of the resilient cutting member 12. The lead cutter 7 is just positioned against the beard stubble 16 with its sharp cutting edge 10. In FIG. 4 the shaving cutter 5 and the lead cutter 7 have slightly advanced in the direction of rotation P of the cutter roller 3. The sharp edge 10 has slightly penetrated the beard stubble 16 and the lead cutter 7 has pulled the stubble slightly out of the skin 17 owing to the forces which are produced. Subsequently, the stubble can be cut by the shaving cutter 5. In FIG. 5 the beard stubble has been cut completely, whilst the root has withdrawn to a level which is situated below the skin level owing to the natural elasticity of the surrounding skin tissue.

At the side which is to be positioned against the skin the shear cutting member 12 and the skin guide member 11 may be provided with raised portions 12' and 11', which may serve as skin tightening elements.

Preferably, the lead cutter 7 is supported by the shaving cutter 5, which last-mentioned cutter at the front, viewed in the direction of rotation, forms an inclined surface 5' along which the lead cutter 7 can slide.

The lead cutters may be lamellated. The lamellae are then individually mounted for resilience (see FIG. 6). It is obvious that the individual lamellae should not penetrate the hair-entrance aperture.

What is claimed is:

1. A dry-shaving apparatus which comprises a casing provided with a skin-guide member and a shear-cutting member having a cutting edge, a longitudinally extending slot-like helical hair-entrance aperture being formed between said two members, a cutter roller rotatable about a spindle longitudinally mounted in said casing, means to rotate said cutter roller about said spindle, said cutter roller having a plurality of radially extending shaving cutters each having a cutting edge parallel to the axis of the cutter roller, the respective cutting edges of said shaving cutters successively engaging the cutting edge of the shear-cutting member as the cutter roller is rotated, and a generally U-shaped flexible lead cutter positioned between each pair of shaving cutters and opening radially outwardly, one leg of said U-shaped lead cutter being attached to the preceding shaving cutter in the direction of rotation and the other leg having a cutter edge and being resiliently supported by the succeeding shaving cutter for radial inward movement upon engagement of a hair protruding through said hair-entrance aperture by the cutting edge of said other leg.

2. A dry-shaving apparatus according to claim 1, in which there is always a cutting edge of at least one shaving cutter in engagement with the cutting edge of the shear-cutting member.

3. A dry-shaving apparatus according to claim 1, in which the other leg of the lead cutter is lamellated.

* * * * *

UNITED STATES PATENT AND TRADEMARK OFFICE

CERTIFICATE OF CORRECTION

PATENT NO. : 4,151,645

DATED : May 1, 1979

INVENTOR(S) : EDUARD W. TIETJENS

It is certified that error appears in the above—identified patent and that said Letters Patent is hereby corrected as shown below:

Column 2, Line 57, "cutter edge"

should be --cutting edge--

Signed and Sealed this

*Fifth* Day of *July 1983*

[SEAL]

*Attest:*

GERALD J. MOSSINGHOFF

*Attesting Officer*

*Commissioner of Patents and Trademarks*